United States Patent [19]

Wortham, Jr.

[11] 4,402,166

[45] Sep. 6, 1983

[54] SIGN POST WITH STABILIZER

[76] Inventor: Robert R. Wortham, Jr., P.O. Box 9330, Forth Worth, Tex. 76107

[21] Appl. No.: 270,613

[22] Filed: Jun. 5, 1981

[51] Int. Cl.[3] ..... E02D 5/74

[52] U.S. Cl. ..... 52/155; 52/38; 248/156

[58] Field of Search ..... 52/38, 155, 156, 170; 248/156, 545, 530, 532, 533, 85–88

[56] References Cited

U.S. PATENT DOCUMENTS

| | | | |
|---|---|---|---|
| 213,932 | 4/1879 | Powell | 52/155 |
| 1,333,842 | 3/1920 | Durkee | 52/155 |
| 3,937,436 | 2/1976 | Stewart | 52/155 X |
| 4,249,715 | 2/1981 | Repp | 248/545 |
| 4,342,179 | 8/1982 | Hill | 52/155 |

FOREIGN PATENT DOCUMENTS

| | | | |
|---|---|---|---|
| 1557852 | 1/1969 | France | 248/530 |

*Primary Examiner*—Philip C. Kannan
*Attorney, Agent, or Firm*—Peter J. Murphy

[57] ABSTRACT

An elongated stabilizer is coupled to a generally vertical pole or stake, and disposed transverse to the pole or stake, extending in opposite directions therefrom, for engagement with the ground surface. The stabilizer may tilt relative to the post to accommodate inclined terrain. The stabilizer is provided with means defining four guide paths for four separate anchor rods, the rods being elongated linear members with heads at one end. All of the guide paths are disposed in planes generally perpendicular to the longitudinal axis of the stabilizer with two such guide paths being provided at each end of the stabilizer on opposite sides of the post. The two guide paths at each end of the stabilizer are provided to guide the rods at angles relative to a plane common to the pole or stake and the stabilizer, with the paths being inclined at opposite angles relative to that plane so that the anchor rods are driven into the ground at opposite angles relative to that plane. The four anchor rods in addition to the relatively short length of the stake or pole driven into the ground provide a very stable installation of the sign post.

8 Claims, 7 Drawing Figures

SIGN POST WITH STABILIZER

This invention relates to a support post for an advertising sign for temporary placement in a lawn or other ground surface; and more particularly to such sign post with a stabilizer for stabilizing and anchoring the sign and post installation.

This invention is concerned with a post and sign assemblies of the type used extensively by realtors and which are placed on the lawns of residences or other structures to advertise that structure for sale or as being sold. Some of these signs are relatively small, with the sign panels being centered on a stake-type of post to be driven partially into the ground. Popular and more attractive post and sign assemblies, which may be referred to as the sidearm type, include a pole having a height of six feet or more and a transverse arm suspending a sign panel from one side of the pole. With the weight of the arm and panel on one side, there is a tendency for the sidearm pole to tilt, in time, if the pole is not set sufficiently deep or if the supporting ground softens. These sidearm-type sign assemblies are necessarily more massive, and usually require a post-hole digger or other special tools for the proper setting of the pole.

Both of the post and sign assemblies described are subject to lateral forces resulting from wind, which forces tend to tilt the post. Both types of post-sign assemblies are subject mischievous vandalism, by young children for example, who may seek simply to rock and loosen the post, or may seek to pull the post from the ground.

When these signs become disarrayed for the above discussed or other reasons, the advertising benefit is diminished at least; and the monitoring and resetting of these signs is a burden to the users. It is desirable therefore to provide a sign post with a stabilizing means which will inhibit whatever forces tend to tilt the sign post set in the ground and produce a disarray of the sign. It is also desirable to provide a sign post with a stabilizer which will assist in supporting the sidearm-type sign assembly and to maintain it in the desired upright condition even when the ground becomes softened. Also it is desirable to provide a sign post with a stabilizer which will inhibit the efforts of mischievous children from tilting the sign and from dislodging the sign from the ground.

An object of this invention is to provide a novel sign post for temporary installation in the ground having means for stabilizing the post in an upright position.

Another object of this invention is to provide such novel sign post wherein the stabilizing means is effective on sloping ground as well as on level ground.

A further object of this invention is to provide a novel sign post wherein the stabilizer means functions as an anchor to inhibit the removal of the post from the ground.

Still another object of this invention is to provide such novel sign post wherein the usual step member is utilized as a part of the stabilizer structure.

A still further object of this invention is to provide such novel sign post which is readily installed and removed with only the simpliest of tools.

Another object of this invention is to provide such novel sign post of simple design, thereby enabling economic manufacture.

These objects are accomplished in a support post which includes an upright post having a lower stake portion to be driven into the ground, and a stabilizer coupled to the post at ground level. The stabilizer is an elongated member coupled to the post in a manner to extend laterally from the post in opposite directions and to engage the ground surface. A plurality of ground anchor rods for association with the stabilizer each consists of an elongated linear stem and an enlarged head. The stabilizer has means defining guide paths for receiving and guiding the stems of the anchor rods into the ground. First and second guide path means are provided adjacent to one end of the stabilizer and spaced from the post, both of these path means being in planes transverse to the longitudinal axis of the stabilizer, and the two path means being disposed at opposite angles relative to the plane of the post and stabilizer. Similar third and fourth guide path means are provided in the stabilizer at the opposite side of the post, these path means also being disposed in planes transverse to the stabilizer and these two path means also being disposed at opposite angles relative to the plane of the post and stabilizer.

The novel features and advantages of the invention, as well as additional objects thereof, will be understood more fully from the following description when read in connection with the accompanying drawings.

DRAWINGS

DESCRIPTION OF THE PREFERRED EMBODIMENTS

Figure 1:
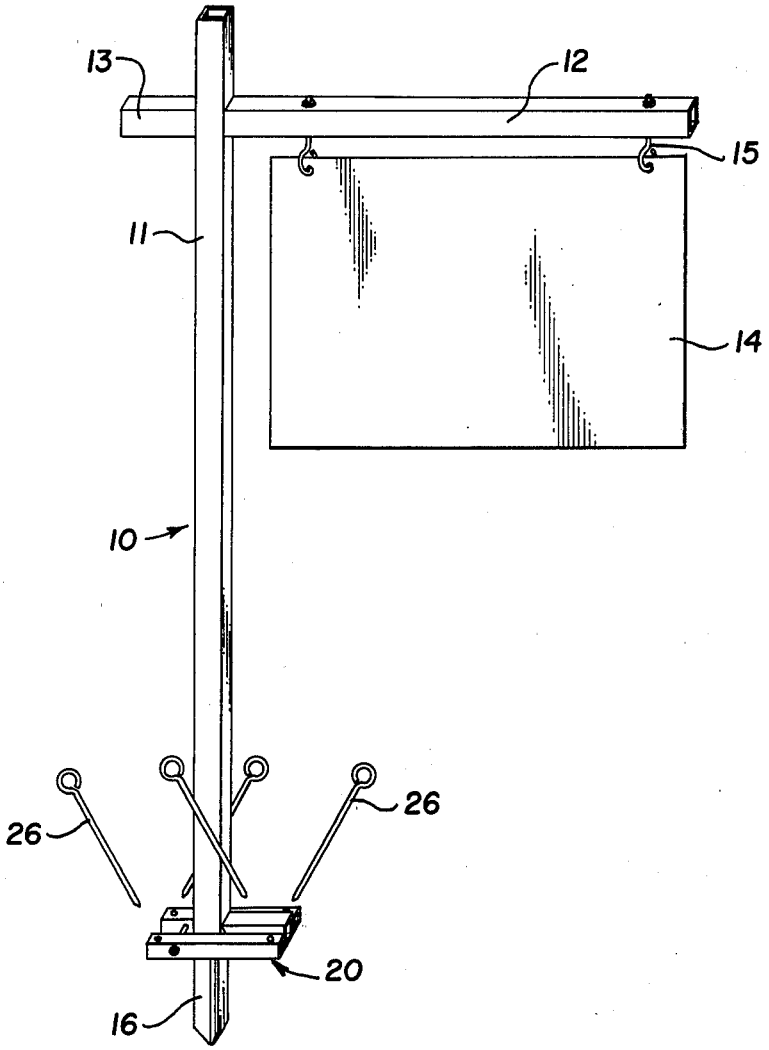
FIG. 1 is a perspective view of one form of sign post according to the invention, with anchor rods separated.

FIGS. 1 through 4 illustrate one form of sign post according to the invention. FIG. 1 is a perspective view of a popular type of sign post, which might be referred to as the sidearm-type sign post, and which suspends the sign panel at one side of the post. This assembly includes, basically, an upright pole 11, a sidearm 12, a sidearm extension 13, and a sign panel 14 suspended from the sidearm 12 by means of eye bolts 15. As an example of the construction materials and size for this sign 10, the pole 11 may be fabricated from $1\frac{1}{2}$ inch square metal tubing and may have an above ground length of 6 feet. The sidearm and sidearm extension may be fabricated from the same metal tubing, the sidearm having a length of 36 inches. The sidearm and sidearm extension may be separable from the pole for convenience of shipping and storage. The sign panel 14 may be fabricated from sheetmetal or other suitable sheet material.

With this sidearm-type of sign, the weight of the sidearm and the sign panel imposes a load which tends to tilt the pole 11 in the direction of the sidearm. Since a sign which is tilted or askew creates an undesirable impression, considerable effort must be made to secure these signs in the ground to prevent this from happening. In typical prior art signs, the upright poles or posts may be fabricated from square or other metal tubing $1\frac{1}{2}$ inch in cross section and larger, or may be fabricated from 4×4 timbers. To provide a secure setting of the sign in the ground, it is usually necessary to use a post-hole digger or other digging apparatus.

In the sign post 10, the upright member includes a separable stake 17 adapted to be driven into the ground with a suitable hammer or mallet and dimensioned to be received within the hollow pole 11. This stake may have an X cross section and may be pointed at one end for easier driving into the ground, and its length may be from 7 to 14 inches for example. The minimum length should be about 7 inches, enabling the stake to be driven into the ground at least 3 to 4 inches, and to project into the pole 11 at least 3 to 4 inches.

A stabilizer 20 for the sign post 10 is an elongated assembly configured to be slideably received on the pole 11 and extend longitudinally from the pole in opposite directions. To enable the function of anchoring the pole, the pole is provided with an out-turned lip at its lower end defining an external peripheral flange 18, and this flange prevents the lower end of the pole from being withdrawn axially from the stabilizer.

Figure 3:
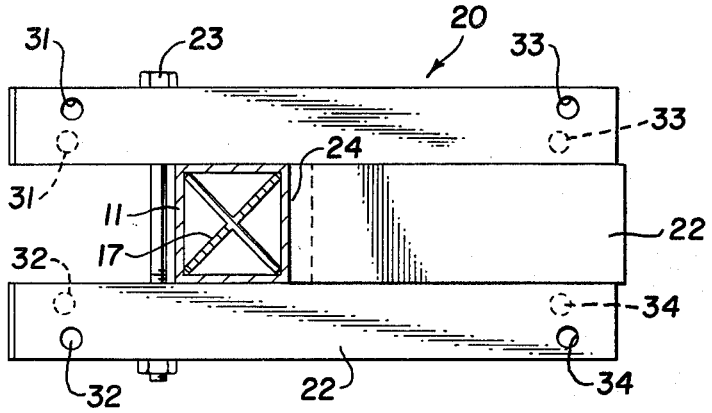
FIG. 3 is a view taken along the line 3—3 of FIG. 2 omitting the anchor rods.
Figure 2:
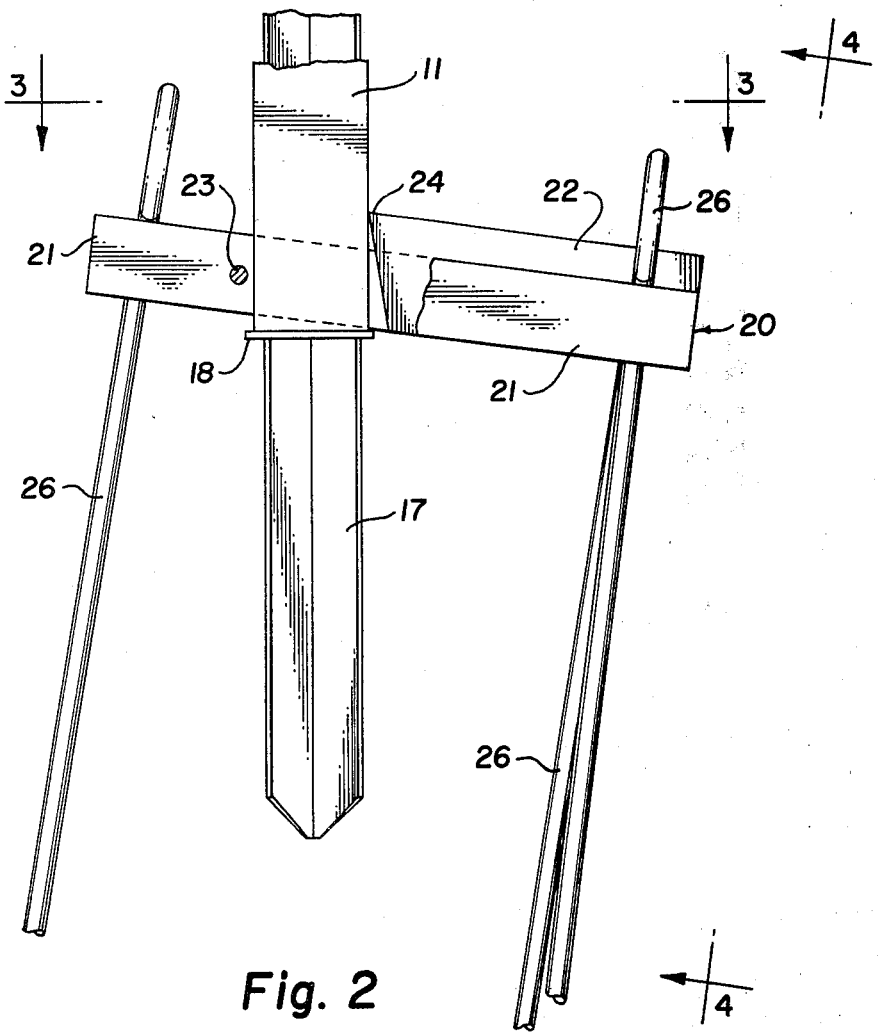
FIG. 2 is a fragmentary elevation view of the lower end of the sign post of FIG. 1, with anchor rods assembled.
Figure 4:
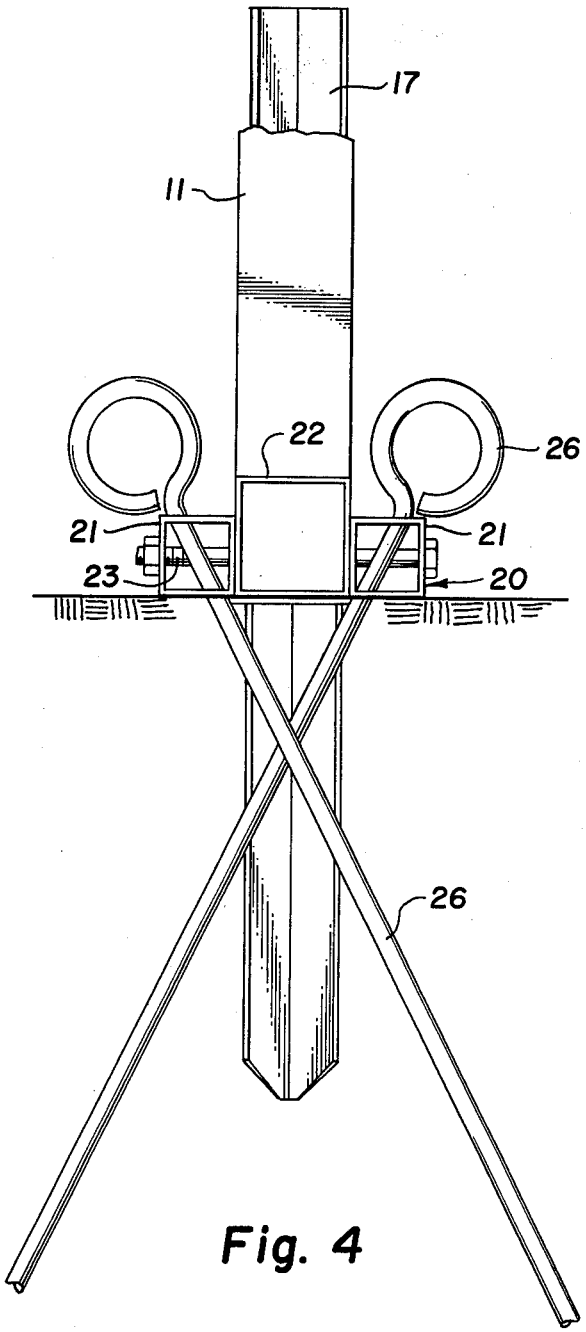
FIG. 4 is an elevation view of the assembly of FIG. 2, as viewed from the plane 4—4 of FIG. 2.

As best seen in FIGS. 2, 3, and 4, the stabilizer 20 for the sign post 10 is an assembly consisting of a pair of elongated tubular members 21 joined at one end by a spacer member 22 to form a bifurcated unit. The elongated members 21 may be fabricated from 1 inch square tubing for example while the spacer member is fabricated from $1\frac{1}{2}$ inch square tubing, the same material as the pole 11. The bifurcated stabilizer then is dimensioned to receive closely the pole 11. A bolt 23 is passed transversely through the tubular members, spaced longitudinally from the spacer 22; and this bolt together with the tubular members and the spacer define a passage through the stabilizer for the pole. As best seen in FIG. 2, the inner end of the spacer 22 is inclined to define a bearing ridge 24 adjacent to the upper surface of the spacer, which ridge bears against the pole 11. This ridge is located, relative to the bolt 23, so that the stabilizer may not be oriented exactly perpendicular to the pole 11, but must always be inclined at least slightly from a perpendicular position relative to the pole, as illustrated in FIG. 2, and may be inclined as much as 30 degrees from the perpendicular for example. This relationship will permit the stabilizer to have full contact with sloping ground while the pole is maintained substantially vertical. In perfectly flat ground, if the pole is to be maintained vertical, the stabilizer must have a slight inclination from the horizontal. In practice it is desirable to incline the pole 11 slightly from the vertical, away from the direction of the sidearm 12 to compensate somewhat for the off-center load of the sidearm and suspended sign panel.

For any installation of the sign post 10, the stabilizer 20 will be positioned and anchored with the bearing ridge 24 bearing against the pole 11 as will be described more fully below. As already mentioned, the elongated tubular members 21 are dimensioned to closely contain the pole 11, and these members will engage the pole flange 18 to prevent axial withdrawal of the pole. For assembly or disassembly of the stabilizer and pole, the bolt 23 is removed.

The stabilizer members 21 are provided with four sets of aligned holes which provide four separate guide paths for four separate anchor rods 26. The anchor rods are fabricated from $\frac{1}{4}$ inch steel rod stock for example, and may have a length of about 15 inches including a head in the form of a closed eye at one end for example. As best seen in FIG. 3, the tubular members 21 are provided with four pairs of aligned holes 31, 32, 33, and 34 respectively, each pair defining a guide path for one anchor rod 26. While it will be seen that the guide path holes 33 and 34, for example, are disposed in a common plane, the holes will be dimensioned large enough to permit the rods to pass each other as illustrated in FIG. 2. As best seen in FIG. 4, the guide paths are provided to guide the anchor rods at a substantial angle relative to the vertical plane defined by the pole 11 and the stabilizer 20; and it is desirable that this angle be in the range of 30 degrees to 45 degrees from the vertical for example.

The installation of this sign post 10 in a yard may be accomplished very easily. Assuming that a sign location is selected on fairly level ground, the stake 17 is first driven into the ground to a depth preferably of 6 inches and this stake may be inclined slightly away from the selected direction of the sidearm 12 if desired. The stabilizer 20 has been assembled with the pole 11 with the spacer end of the stabilizer extending in the same direction from the pole as the sidearm 12. The stabilizer 20 may be pressed firmly against the ground surface by stepping on the stabilizer, with the bearing ridge 24 urged against the side of the pole. If the ground is perfectly level, it may be necessary to embed slightly the spacer end of the stabilizer by foot pressure. The anchor rods 26 are then driven into the ground utilizing the respective guide paths, by means of a common hammer for example.

It will be seen that the stabilizer 20 is very securely anchored against movement particularly in a longitudinal direction; and the sign post assembly of the pole 11 and the stake 17 is very well stabilized by both the stake 17 and the stabilizer against rocking movement particularly in the direction of the sidearm 22. The coaction of the stake 17 and the stabilizer assembly also stabilizes the sign against rocking movement in the other directions. For sloping terrain, the stabilizer may still be oriented flush to the ground surface and perform the stabilizing function in the same manner, with the bearing ridge 24 always bearing against the pole 11. It is almost impossible to remove the sign post without first removing the anchor rods 26 and the manner of removing the anchor rods will not be immediately apparent to mischievous young children for example. In the installed relationship, the eyes of the anchor rods 26 are close together; and if loss of sign posts due to vandalism is a problem, the eyes of the four anchor rods may be linked together by means of a taut chain and padlock to make removal of the anchor rods from the assembly impossible. It is then almost impossible to remove the sign post.

EMBODIMENT OF FIGS. 5 THROUGH 7

Figure 5:
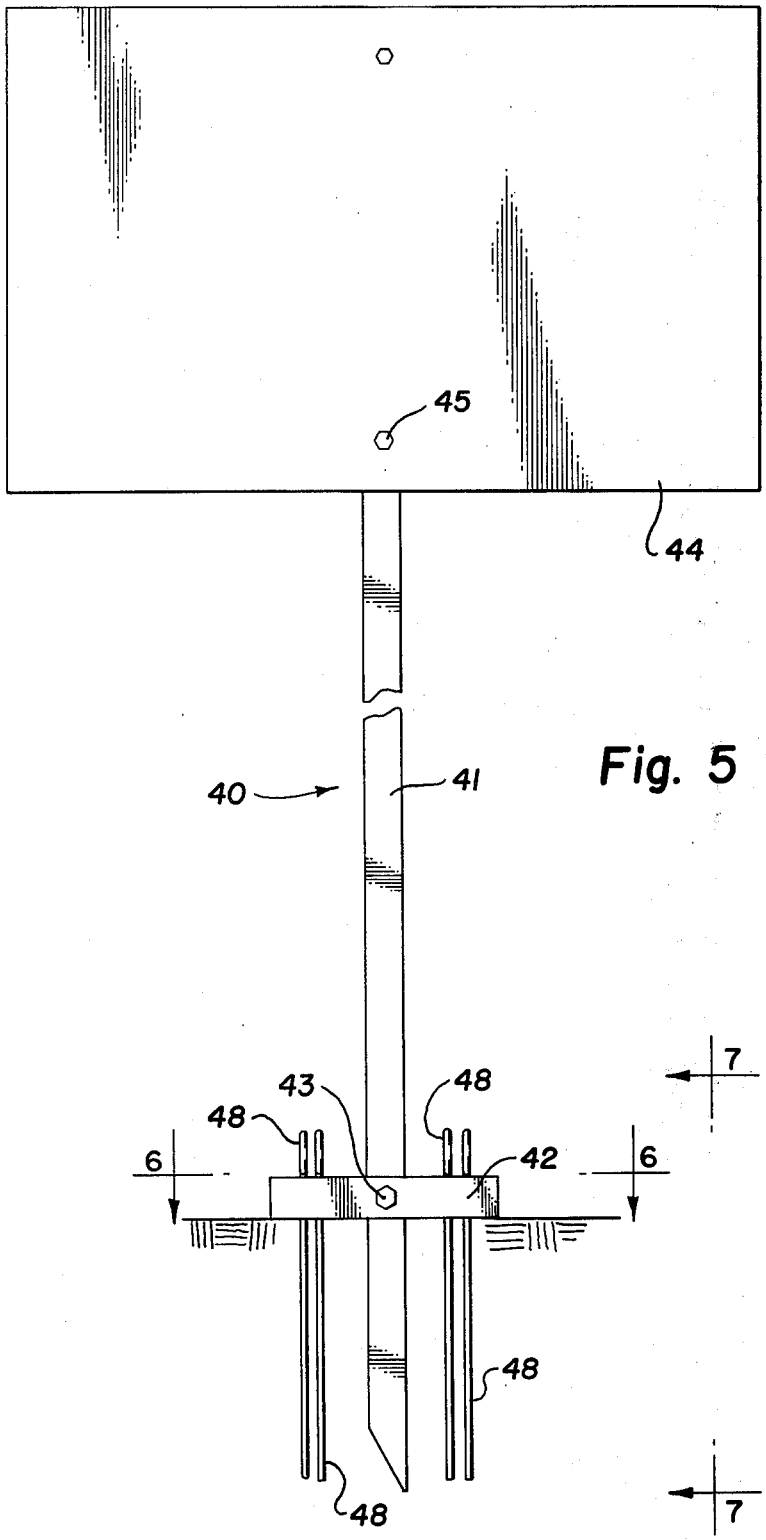
FIG. 5 is an elevation view of another form of sign post according to the invention.
Figure 6:
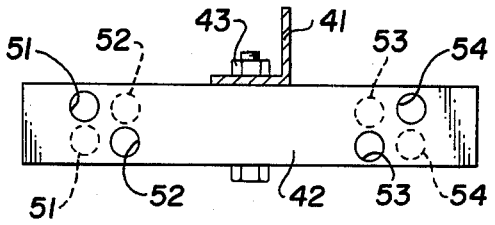
FIG. 6 is a view taken along the line 6—6 of FIG. 5 with the anchor rods omitted.
Figure 7:
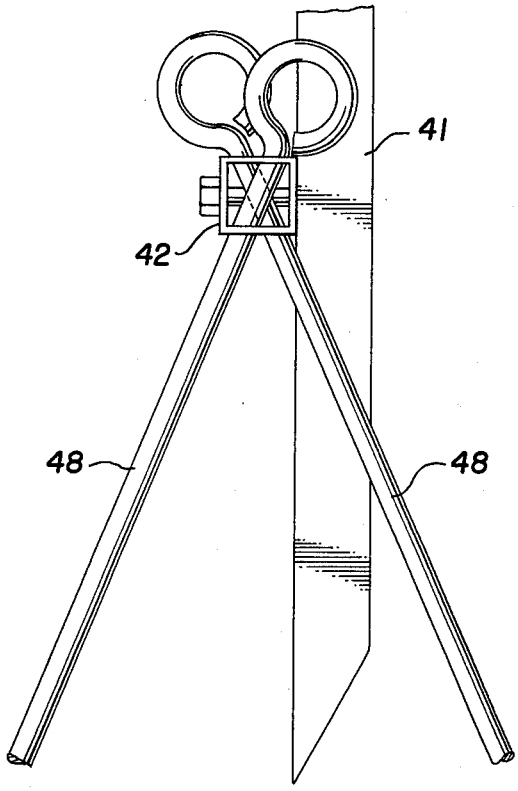
FIG. 7 is an elevation view of the bottom portion of the sign post of FIG. 5, as viewed from the plane 7—7 of FIG. 5.

FIGS. 5 through 7 illustrate a simpler form of sign post 40 according to the invention, the sign post consisting of a vertical stake 41, and a transverse stabilizer 42 secured to the stake by a stove bolt assembly 43. A sign panel 44 fabricated from a suitable sheet material is secured to the stake in centered relation by stove bolts 45 for example. This type of sign post is suitable for smaller signs; and the stake 41 may be fabricated from 1 inch angle iron having a length of about 54 inches for example including a length of about 6 inches below the stabilizer 42 to be driven into the ground. The stabilizer 22 may be fabricated from a 6 inch length of 1 inch square tubing for example, pivotally mounted to the stake by means of the single bolt assembly 43. With the pivotal mounting, the stabilizer may be pressed firmly against the ground surface for either level or inclined terrain.

A stabilizer is provided with four pairs of aligned holes defining respective guide paths for separate anchor rods 48. The anchor rods are fabricated preferably from ¼ inch rod stock having a length of about 15 inches including heads in the form of closed eyes formed at one end. Four pairs of aligned holes 51, 52, 53 and 54 are provided in the stabilizer 42, each pair defining a guide path disposed in a plane perpendicular to the longitudinal axis of the stabilizer 42. The guide paths 51 and 52 are disposed adjacent to one end of the stabilizer and on one side of the stake 41 while the guide paths 53 and 54 are disposed adjacent to the opposite end of the stabilizer and at the opposite side of the stake 41. In the illustrated example, these guide paths are spaced 1½ inches and 2 inches from the stake 41. As best seen in FIG. 7, the guide paths orient the rods 48 at a substantial angle relative to a plane defined by the stake 41 and the stabilizer 42. These rods are illustrated at an angle of about 30 degrees from that plane; and the angle is preferably in the range of 30 degrees to 45 degrees from that plane.

It will be seen that this sign post assembly is quite stable when mounted in the ground, being stabilized against tilting movement in all directions by the combination of the lower end of the stake and the four anchor rods all being driven into the ground. Removal of the sign from the ground is almost impossible without first removing the anchor rods; and the manner of removing the anchor rods will not be immediately apparent to mischievous children. Again, to prevent loss of signs due to vandalism, the eyes of the four anchor rods may be linked together by a chain and padlock to virtually prevent removal of the sign post from the ground.

Both of the above-described sign posts 10 and 40 may be readily installed at a desired location requiring only a common hammer. Since the stake 17 of the sign post 10, and the stake 41 of the sign post 40 need only to be driven into the ground a maximum of 6 inches for example, this is not difficult with an ordinary hammer. Conversely, sign posts without a stabilizer need to be driven or set in the ground to a much greater depth. Similarly, removal of the sign posts is not difficult. The ¼ inch anchor rods may be removed fairly readily possibly by side tapping with a hammer to loosen the rods and utilizing a hammer claw to withdraw the rods. Since the stakes are only set in the ground 6 inches, they may be readily loosened by rocking the longer stake 41 or by side tapping the short stake 17 with a hammer.

What has been described is a novel support post which is particularly useful for yard signs of the type used by realtors. An important feature and advantage of the invention is that a relatively simple sign post structure is provided which is well stabilized against lateral tilting or rocking movements from whatever source, such as the wind or mischievous children. An ancillary advantage is that the stabilizing of the sign post is accomplished whether the sign is placed on level or sloping terrain.

Another important feature and advantage of the invention is that the sign posts having this stabilizing feature are very easily installed and removed, requiring only the most common tool such as a hammer, and this may be accomplished readily by persons of slight stature and strength.

An advantage of the stabilizing feature is that the stake portions of the sign posts need not be set deeply into the ground to accomplish the stabilizing effect; and the smaller sign may likely be installed in soft ground merely by utilizing the stabilizer as a foot step.

Another feature of the invention is that the stabilizing sign posts are quite simple in structure and may be manufactured at a reasonable cost.

While the preferred embodiments of the invention have been illustrated and described, it will be understood by those skilled in the art that changes and modifications may be resorted to without departing from the spirit and scope of the invention. For example, a stabilizer according to the invention may be used in combination with a double post or double stake sign.

What is claimed is:

1. A support post comprising an upright post including a lower stake portion to be driven into the ground;

an elongated stabilizer for coupling to said post, to be disposed transverse to said post for engagement with the ground surface and extending in opposite directions from said post; said stabilizer being pivotally coupled to said post, to conform to the ground contour while said post is generally vertical;

a plurality of ground anchor rods, each comprising an elongated linear stem and an enlarged head;

said stabilizer having means defining guide paths for receiving and guiding the stems of said anchor rods into the ground;

said guide path means including first and second path means disposed in planes transverse to the longitudinal axis of said stabilizer and spaced in one direction from said post; said first and second path means being disposed to guide first and second anchor rods at an angle relative to the plane of said post and said stabilizer, with said rods traversing said plane from opposite sides thereof;

and said guide path means including third and fourth path means disposed in planes transverse to the longitudinal axis of said stabilizer and spaced in the opposite direction from said post; said third and fourth path means being disposed to guide third and fourth anchor rods at an angle relative to the plane of said post and said stabilizer with said rods traversing said plane from opposite sides thereof.

2. A support post as set forth in claim 1 said anchor rod heads comprising closed eyes, adapted to be linked together with a chain.

3. A support post as set forth in claim 1 said post comprising a metal stake in the form of angle iron.

4. A support post comprising an upright post including a lower stake portion to be driven into the ground;

an elongated stabilizer for coupling to said post, to be disposed transverse to said post for engagement with the ground surface and extending in opposite directions from said post;

a plurality of ground anchor rods, each comprising an elongated linear stem and an enlarged head;

said stabilizer having means defining guide paths for receiving and guiding the stems of said anchor rods into the ground;

said guide path means including first and second path means disposed in planes transverse to the longitudinal axis of said stabilizer and spaced in one direction from said post; said first and second path means being disposed to guide first and second anchor rods at an angle relative to the plane of said post and said stabilizer, with said rods traversing said plane from opposite sides thereof;

said guide path means including third and fourth path means disposed in planes transverse to the longitudinal axis of said stabilizer and spaced in the opposite direction from said post; said third and fourth path means being disposed to guide third and fourth anchor rods at an angle relative to the plane of said post and said stabilizer with said rods traversing said plane from opposite sides thereof;

said stabilizer comprising a length of rectangular tubing; said guide path means comprising aligned holes formed in said tubing.

5. A support post comprising an upright post including a lower stake portion to be driven into the ground; said post comprising an above-ground pole fabricated from a length of hollow tubing, and said stake portion comprising a separable member dimensioned to be received within said tubing; said pole having laterally outward projecting flange means at its lower end;

an elongated stabilizer for coupling to said post, to be disposed transverse to said post for engagement with the ground surface and extending in opposite directions from said post; said stabilizer comprising an elongated assembly having transverse passage means dimensioned to receive said pole in sliding relation; said flange means of said pole being configured to retain said stabilizer assembly;

a plurality of ground anchor rods, each comprising an elongated linear stem and an enlarged head;

said stabilizer having means defining guide paths for receiving and guiding the stems of said anchor rods into the ground;

said guide path means including first and second path means disposed in planes transverse to the longitudinal axis of said stabilizer and spaced in one direction from said post; said first and second path means being disposed to guide first and second anchor rods at an angle relative to the plane of said post and said stabilizer, with said rods traversing said plane from opposite sides thereof;

and said guide path means including third and fourth path means disposed in planes transverse to the longitudinal axis of said stabilizer and spaced in the opposite direction from said post; said third and fourth path means being disposed to guide third and fourth anchor rods at an angle relative to the plane of said post and said stabilizer with said rods traversing said plane from opposite sides thereof.

6. A support post as set forth in claim 5 said stake portion having a minimum length of about 7 inches.

7. A support post as set forth in claim 6 said stabilizer assembly comprising a bifurcated member including a pair of spaced parallel legs, and bolt means traversing said legs to define said passage means for said pole.

8. A support post as set forth in claim 7 the base of said bifurcated member including a lateral bearing ridge, for bearing engagement with said pole.

* * * * *